US009727073B1

(12) United States Patent
Voo

(10) Patent No.: US 9,727,073 B1
(45) Date of Patent: Aug. 8, 2017

(54) PRECISION CURRENT SOURCE WITH PROGRAMMABLE SLEW RATE CONTROL

(71) Applicant: Marvell International Ltd., Hamilton (BM)

(72) Inventor: Thart Fah Voo, Singapore (SG)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/055,448

(22) Filed: Oct. 16, 2013

Related U.S. Application Data

(60) Provisional application No. 61/714,997, filed on Oct. 17, 2012.

(51) Int. Cl.

| | |
|---|---|
| ***G05F 3/26*** | (2006.01) |
| ***G05F 3/02*** | (2006.01) |
| ***G05F 1/59*** | (2006.01) |
| ***G05F 1/613*** | (2006.01) |
| *G05F 1/565* | (2006.01) |
| *G05F 1/618* | (2006.01) |

(52) U.S. Cl.
CPC ..... *G05F 3/02* (2013.01); *G05F 1/59* (2013.01); *G05F 1/613* (2013.01); *G05F 3/262* (2013.01); *G05F 1/565* (2013.01); *G05F 1/618* (2013.01); *G05F 3/26* (2013.01)

(58) Field of Classification Search
CPC . G05F 1/59; G05F 1/613; G05F 1/618; G05F 1/26; G05F 1/262
USPC ..... 323/273, 274, 275, 278, 279, 280, 281, 323/311, 313
See application file for complete search history.

(56) References Cited

U.S. PATENT DOCUMENTS

| | | | | |
|---|---|---|---|---|
| 6,300,752 | B1 * | 10/2001 | Mack | 323/313 |
| 7,495,423 | B1 * | 2/2009 | Knight et al. | 323/284 |
| 7,538,528 | B2 * | 5/2009 | Heath | 323/274 |
| 7,782,039 | B1 * | 8/2010 | He | 323/288 |
| 7,863,875 | B1 * | 1/2011 | Guo et al. | 323/275 |
| 2003/0147193 | A1 * | 8/2003 | Hamon | G05F 1/573 361/87 |
| 2006/0055388 | A1 * | 3/2006 | Tang et al. | 323/284 |
| 2006/0152205 | A1 * | 7/2006 | Tang et al. | 323/284 |
| 2008/0061752 | A1 * | 3/2008 | Heath | 323/277 |
| 2009/0039846 | A1 * | 2/2009 | Ito et al. | 323/277 |
| 2010/0001706 | A1 * | 1/2010 | Nguyen | 323/288 |
| 2010/0188057 | A1 * | 7/2010 | Tarng | 323/225 |
| 2011/0068760 | A1 * | 3/2011 | Zhou | 323/282 |
| 2011/0074377 | A1 * | 3/2011 | Ooga | 323/303 |
| 2011/0148388 | A1 * | 6/2011 | Zanchi et al. | 323/313 |
| 2011/0181262 | A1 * | 7/2011 | Deguchi | 323/284 |

(Continued)

*Primary Examiner* — Harry Behm
*Assistant Examiner* — Bryan R Perez

(57) ABSTRACT

New devices and methods for producing a precision current source or sink with programmable slew rate are disclosed. For example, an electronic circuit capable of providing precision current control including a programmable slew rate is disclosed. For example, the electronic circuit can include a constant current circuit configured to provide a constant current, and a transient current circuit coupled to the constant current circuit at a common electrical node, the transient current circuit configured to sample the constant current of the constant current circuit during a sampling phase, then provide a turn-on programmable slew rate based on the sampled constant current during an active phase.

9 Claims, 7 Drawing Sheets

(56) References Cited

U.S. PATENT DOCUMENTS

| | | | | |
|---|---|---|---|---|
| 2012/0153913 | A1* | 6/2012 | Wan et al. | 323/282 |
| 2013/0200873 | A1* | 8/2013 | Wu | H02M 3/156<br>323/288 |

* cited by examiner

PRECISION CURRENT SOURCE WITH PROGRAMMABLE SLEW RATE CONTROL

INCORPORATION BY REFERENCE

This application claims the benefit of U.S. Provisional Application No. 61/714,997 entitled "PRECISION CURRENT WITH PROGRAMMABLE SLEW RATE CONTROL" filed on Oct. 17, 2012, the content of which is incorporated herein by reference in its entirety.

BACKGROUND

Current supply devices, i.e., current sources and current sinks, are used for a large variety of circuits, such as analog amplifiers and data acquisition devices. Often these devices are required to provide a highly precise reference current while at the same time be restrained by other factors.

SUMMARY

Various aspects and embodiments of the invention are described in further detail below.

In an embodiment, electronic circuit capable of providing precision current control including a programmable slew rate is disclosed. The electronic circuit includes a constant current circuit configured to provide a constant current, and a transient current circuit coupled to the constant current circuit at a common electrical node, the transient current circuit configured to sample the constant current of the constant current circuit during a sampling phase, then provide a turn-on programmable slew rate based on the sampled constant current during an active phase following the sample phase.

In another embodiment, a method for providing precision current control including a programmable slew rate is disclosed. The method includes providing a constant current, sampling the constant current to produce a sampled current during a sampling phase, producing a transient current according to a predetermined waveform based on the sampled current during an active phase, and subtracting the transient current from the constant current to provide an output current having a turn-on slew rate that varies according to the predetermined waveform.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

The disclosed methods and systems below may be described generally, as well as in terms of specific examples and/or specific embodiments. For instances where references are made to detailed examples and/or embodiments, it is noted that any of the underlying principles described are not to be limited to a single embodiment, but may be expanded for use with any of the other methods and systems described herein as will be understood by one of ordinary skill in the art unless otherwise stated specifically.

Figure 1:
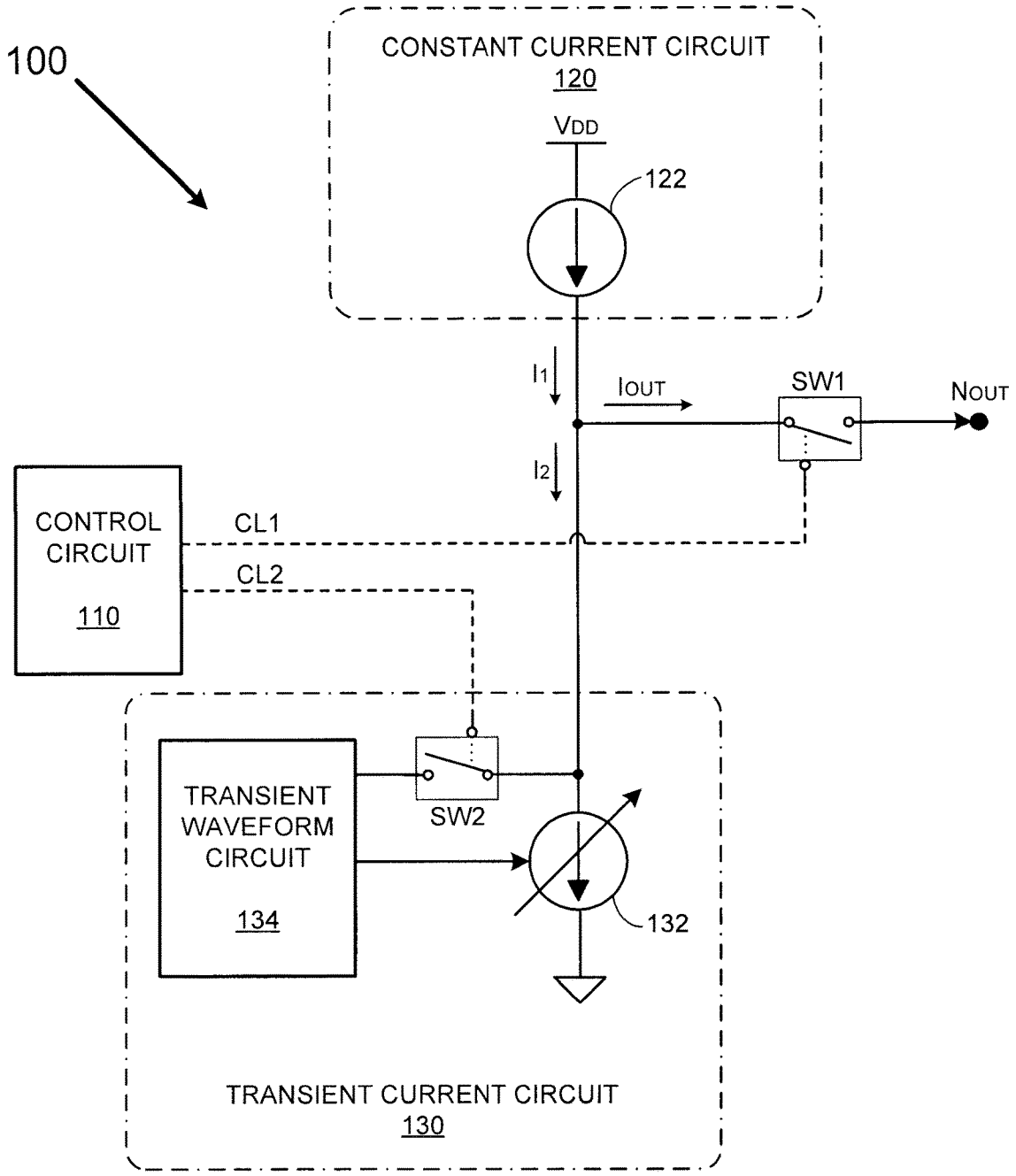
FIG. 1 is a generalize example of a current source with programmable slew rate.

FIG. 1 is a generalize example of a precision current source 100 with programmable slew rate. The current source 100 includes a control circuit 110, a constant current circuit 120, a transient current circuit 130, and an open/closed output switch SW1.

The control circuit 110 of FIG. 1 includes an assortment of electronic components, including timing components, delays and drivers, capable of manipulating any number of switches. The precise makeup of the control circuit 110 can vary from embodiment to embodiment to encompass different types of functional components as well as different types of technologies, such as analog and digital electronics, optical components and/or any other viable technology capable of controlling a plurality of switches.

The constant current circuit 120 of FIG. 1 includes an idealized current source 122. The idealized current source 122 can take any number of forms, such as one or more transistors acting as a current mirror, as is readily known to those of ordinary skill in the art in light of this disclosure. The constant current circuit 120 produces a constant current $I_1$.

The transient current circuit 130 of FIG. 1 includes an idealized variable current source 132 controlled by a transient waveform circuit 134, and two open/closed sampling switches SW2 and SW2B. The constant current circuit 120 produces a transient current $I_2$.

In operation, there are two operational phases: a sampling phase followed by an active phase.

During the sampling phase, the control circuit 100 opens the output switch SW1, closes the sampling switch SW2 and opens switch SW2B. This causes the output current IouT to equal zero, and current $I_1$ to equal current $I_2$, thus allowing the transient current circuit 130 to accurately measure/sample the current $I_1$ provided by the constant current circuit 120. Once the transient current circuit 130 has measured the current $I_1$ provided by the constant current circuit 120, the control circuit 100 closes the output switch SW1, opens sampling switch SW2 and closes switch SW2B such that the output current $I_{OUT}$ equal current $I_1$ minus current $I_2$, i.e., $I_{OUT}=I_1-I_2$.

Figure 2:
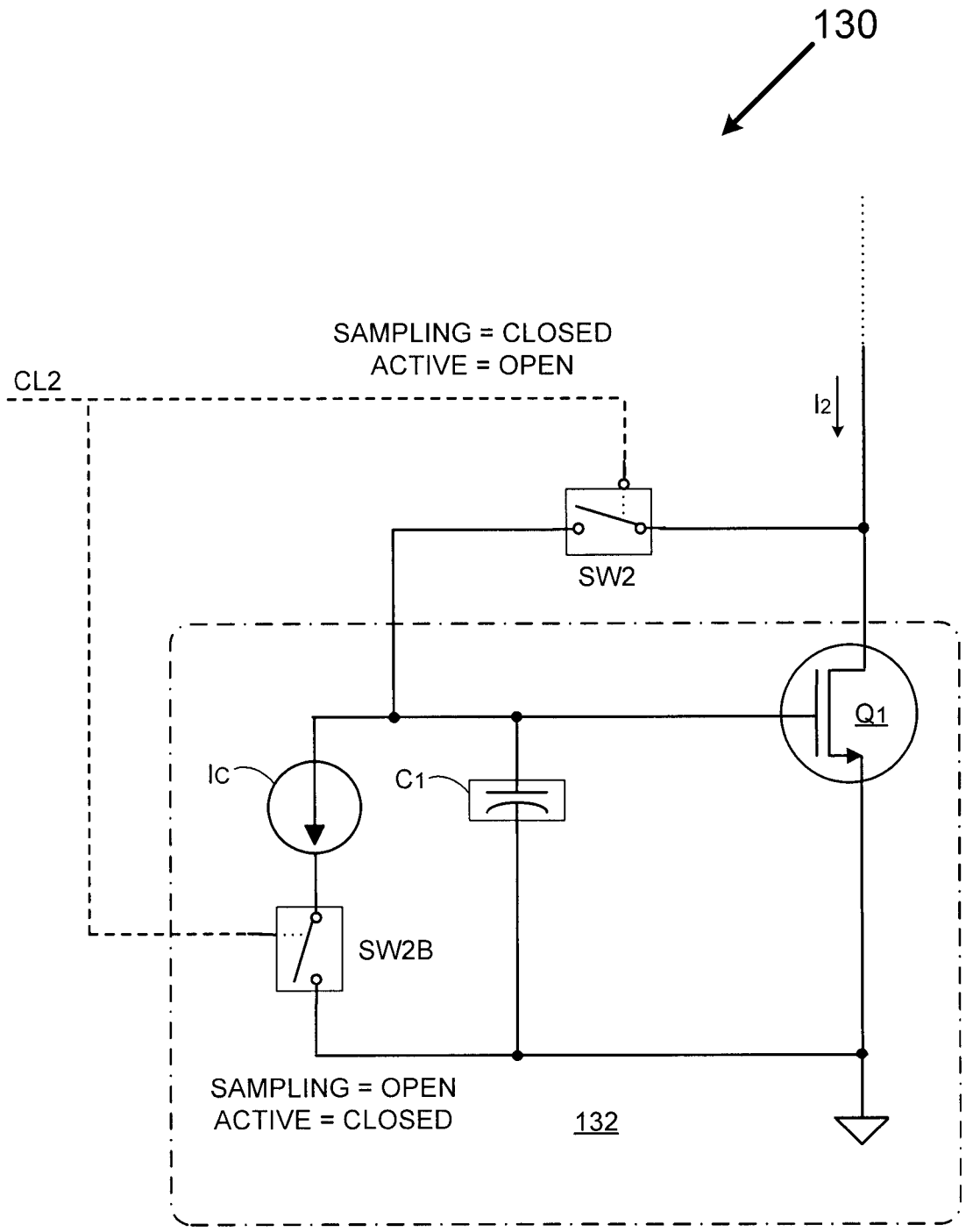
FIG. 2 is an example of a realizable transient current circuit usable for the current source of FIG. 1 and capable of producing a linear slew.
Figure 3:
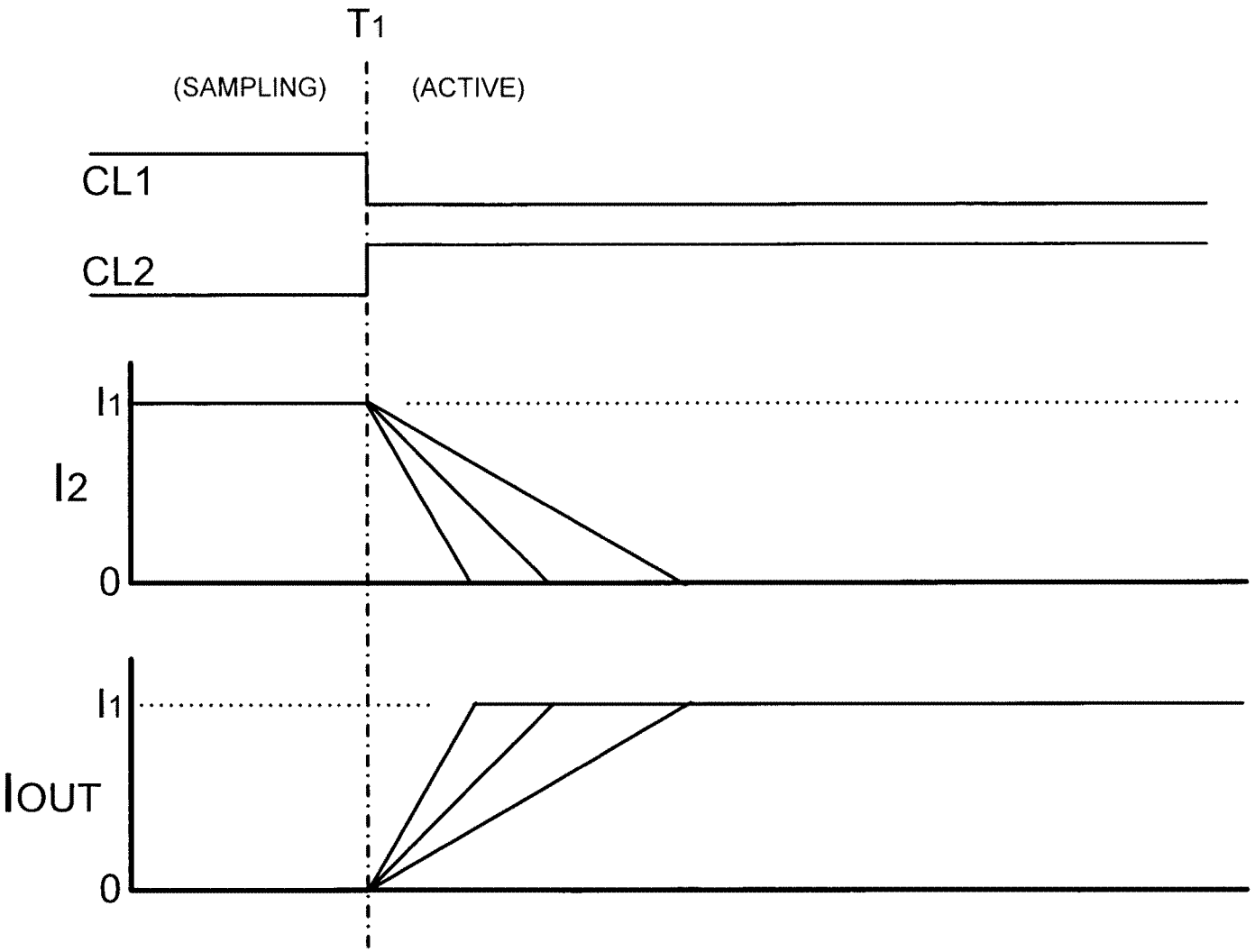
FIG. 3 depicts various waveforms generated by the circuitry of FIGS. 1 and 2.

FIG. 2 is an example of a realizable transient current circuit 130 usable for the current source 100 of FIG. 1 capable of producing a linear slew as will be further described in FIG. 3. As shown in FIG. 2, the realizable transient current circuit 130 includes a transistor $Q_1$ acting as a variable/controllable current source, and a capacitor $C_1$ in parallel with constant current source $I_C$, which as known to those skilled in the relevant arts in view of this disclosure can be a current mirror or any number of known or later developed electronic circuits.

During the sampling phase when $I_1=I_2$, the voltage across capacitor $C_1$ is charged so as to bias the gate of transistor $Q_1$ until a steady state condition is reached, i.e., the voltage across the capacitor $C_1$ and the current though the transistor $Q_1$ are unchanging. Upon start of the active phase when the sampling switch SW2 is opened and SW2B is closed, the voltage across the capacitor $C_1$ will drop as a linear function of time. Accordingly, the current through the transistor $Q_1$ will linearly decline as a function of the declining voltage across capacitor $C_1$ until $I_2=0$.

Often, a circuit may have a settling requirement. This means that a current must settle to a certain accuracy. For the devices in this disclosure, however, current $I_1$ is settled long before needed such that as the circuit switches modes, current $I_1$ will settle 100% once the transient operation is completed FIG. 3 depicts various waveforms of the circuitry of FIGS. 1 and 2. As is shown in FIG. 3, there is sampling phase that transitions to an active phase at time $T_1$. Control lines CL1 and CL2 (generated by control circuit 110), which control the output switch SW1 and the sampling switch SW2 of FIG. 1, cause current $I_2$ to equal current $I_1$, and output current $I_{OUT}$ to equal zero prior to time $T_1$. While control lines CL1 and CL2 appear inverted to one another, this is depicted so as to give an idea that some switches will be opened while others are closed. A single control line for all switches may be sufficient assuming that such switches are appropriately active high or low.

After time $T_1$, however, current $I_2$ transitions linearly to zero according to a predetermined slope based on the value of the capacitor $C_1$ and the current source $I_C$ of FIG. 2. As current $I_2$ transitions to zero, the output current $I_{OUT}$ transitions to current $I_1$ according to the equation: $I_{OUT}=I_1-I_2$.

Figure 4:
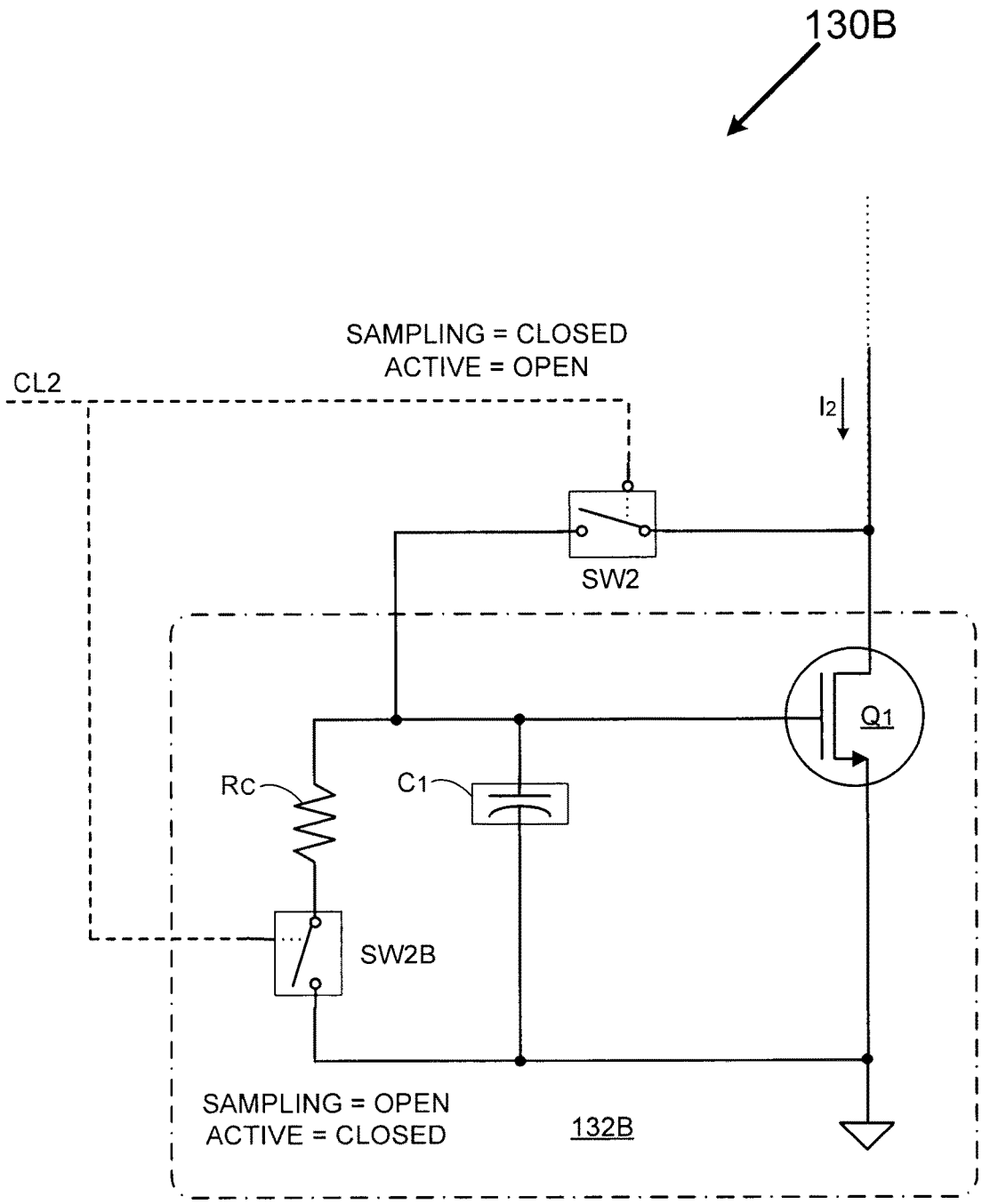
FIG. 4 is an example of a second type of transient current circuit usable for the current source of FIG. 1 and capable of producing an exponential slew.

FIG. 4 is a second example of transient current circuit 120B usable for the current source of FIG. 1 capable of producing an exponential slew. The circuitry is identical to that of FIG. 2 except that current source $I_C$ is replaced by resistor $R_C$. Upon transition to an active phase, the waveform of current $I_2$ will decline according to the equation: $I_2=I_1\times e^{(-t/RC)}$. FIG. 4 demonstrates that an onset slew rate for the current source 100 of FIG. 1 can be manipulated to nearly any type of waveform based by used of any combination of linear components, e.g., resistors and capacitors, and non-linear components, such as diodes. Accordingly, a wide variety of slew waveforms may be provided as may be found necessary, useful or otherwise desirable.

Figure 5:
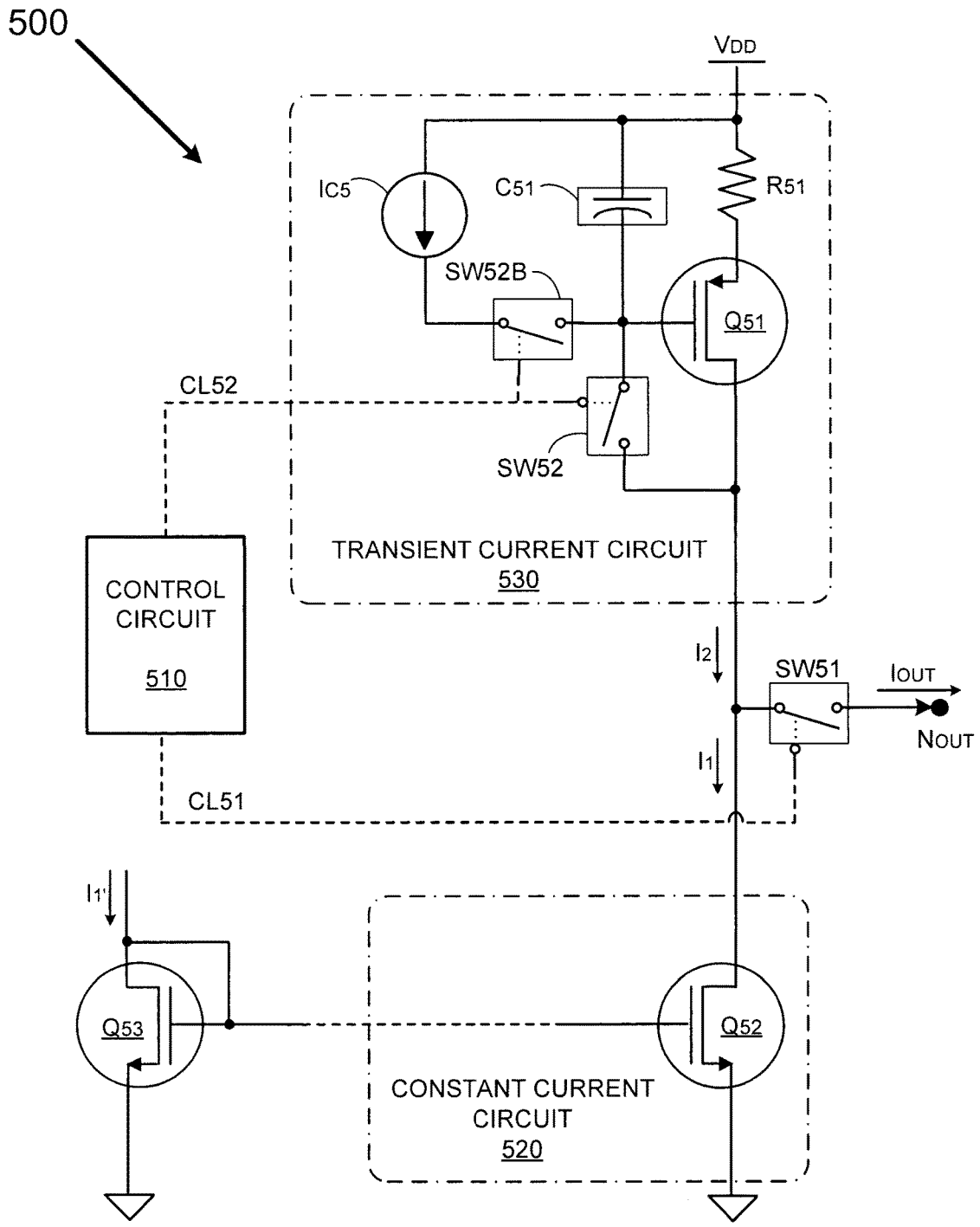
FIG. 5 is an example of a current source with programmable slew rate.

FIG. 5 is an example of a precision current sink 500 with programmable slew rate that can acts as a complement to the current source 100 of FIG. 1. The current sink 500 includes a control circuit 510, a constant current circuit 520, a transient current circuit 530, and an output switch SW51.

The constant current circuit 520 includes transistor $Q_{52}$ acting as a current mirror to transistor $Q_{53}$.

The transient current circuit 530 includes transistor $Q_{51}$ acting as a variable current source, sampling switches SW52 and SW52B, and a capacitor $C_{51}$ in parallel with current source $I_{C5}$.

As with the current source 100 of FIG. 1, there are two operational phases: a sampling phase followed by an active phase. One of ordinary skill in the art viewing this disclosure will readily see that the operation of the current sink 500 of FIG. 5 is analogous to that of the current source 100 of FIG. 1. As such, a detailed description of the operation of the current sink 500 is omitted here.

Figure 6:
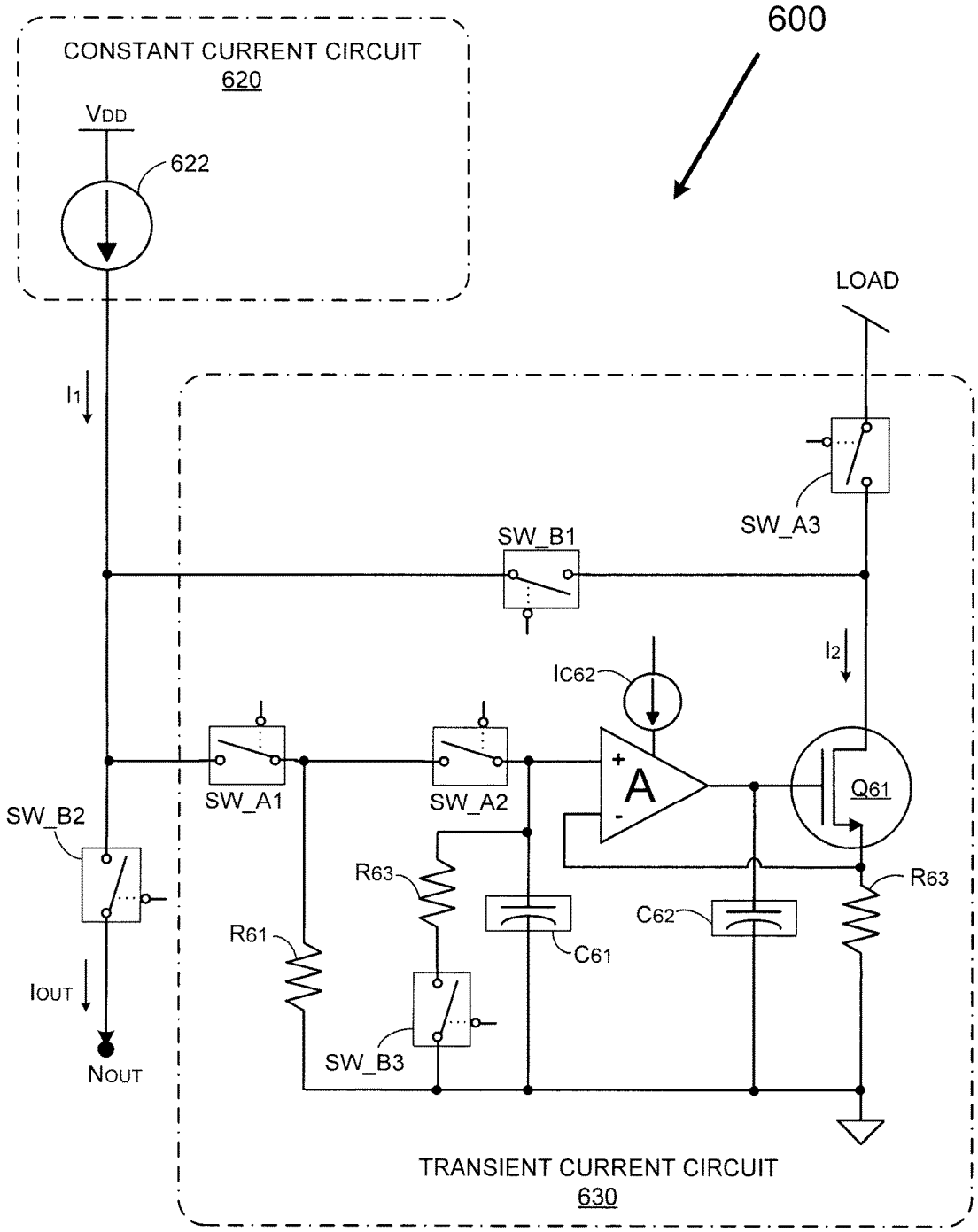
FIG. 6 is a second example of a precision current source with programmable slew rate having improved linearity as compared to the circuit examples of FIGS. 1 and 5.

FIG. 6 is another example of a current source 600 with programmable slew rate having improved linearity as compared to the devices of FIGS. 1 and 5. The current source 600 includes control circuitry (not shown so as to reduce clutter in FIG. 6), an output switch SW_B2, a constant current circuit 620, and a transient current circuit 630.

The constant current circuit 620 includes an idealized current source 622 that produces current steady current $I_1$.

The transient current circuit 630 includes a number of switches {SW_A1, SW_A1, SW_A1, SW_B1, SW_B3}, a first capacitor $C_{61}$ switchably in parallel with a first resistor $R_{61}$ and a third resistor $R_{63}$, an amplifier A fed by a current limiting source $I_{C62}$, a second capacitor $C_{62}$, a transistor $Q_{61}$ and a second resistor $R_{62}$.

During the sampling phase, switches SW_B1, SW_B2 and SW_B3 are open and the remaining switches {SW_A1, SW_A2, SW_A3} are closed. In operation of the sampling phase, the voltage across the first capacitor $C_{61}$ charges, while amplifier A, transistor Q61 and resistor $R_{62}$ act as a voltage-to-current converter to the charge across capacitor $C_{61}$. The current limiting source $I_{C62}$ and second capacitor $C_{62}$ provide stability to the voltage-to-current converter. A load (not shown) above switch SW_A3 provides a compensation current to counteract a measurement current consumed during sampling. Eventually, the transient current circuit 630 will reach a steady state whereby $I_2=I_1$.

During the active phase, switches SW_B1, SW_B2 and SW_B3 are closed and the remaining switches {SW_A1, SW_A2, SW_A3} are opened. The RC constant of the first capacitor $C_{63}$ and first resistor $R_{61}$ provide an exponential decay, which in turn causes current $I_2$ to decay proportionally. As with the previous examples, the first capacitor $C_{61}$ and first resistor $R_{61}$, which for this example constitute a transient waveform circuit, can be replaced with any combination of circuitry to provide a large variety of different onset slew waveforms. For example, by replacing the first resistor $R_{61}$ with a constant current source, a linear slew rate is produced.

Figure 7:
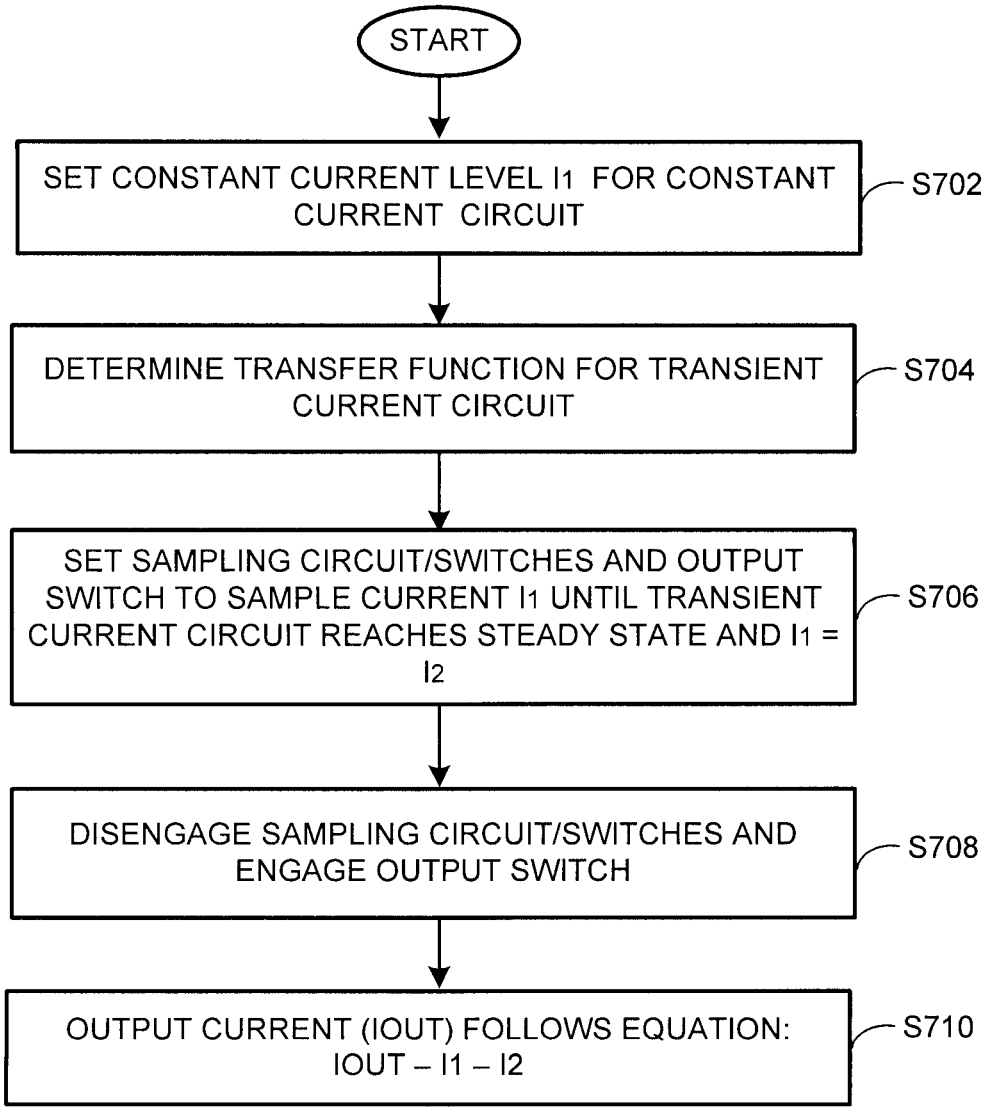
FIG. 7 is a flowchart outlining a set of example operations useful for producing a precision current device with programmable slew rate.

FIG. 7 is a flowchart outlining a set of example operations useful for producing a precision current device with programmable slew rate. It is to be appreciated to those skilled in the art in light of this disclosure that, while the various functions of FIG. 7 are shown according to a particular order for ease of explanation, that certain functions may be performed in different orders or in parallel. The functions below are applicable to any number of current sources or current sinks having a desirable onset slew rate/waveform, including any of those devices described above for FIGS. 1-6.

The process starts at S702 where a current level $I_1$ for a constant current source is set/determined. At S704, a transfer function/waveform for an onset slew rate is determined. As discussed above, such a slew rate waveform can be linear, exponential or any of a large variety of designs as may be found necessary, useful or otherwise desirable. Control continues to S706.

At S706, a number of switches, such as switches SW1 and SW2 of FIG. 1, (and possibly other sampling circuitry) is set so as to enable some form of transient current circuit to sample/mirror current level $I_1$ until a transient current $I_2$ settles to a constant state and $I_1=I_2$. Control continues to S708.

At S708, the state of the switches and sampling circuitry is reconfigured so as to put the current source/sink into an active phase. Then, at S710 the transient current $I_2$ is provided according to the predetermined transfer function/waveform of S704, thus causing the output current of the source/sink to transition from zero to current level $I_1$ according to the equation: $I_{OUT}=I_1-I_2$.

While the invention has been described in conjunction with the specific embodiments thereof that are proposed as examples, it is evident that many alternatives, modifications, and variations will be apparent to those skilled in the art. Accordingly, embodiments of the invention as set forth herein are intended to be illustrative, not limiting. There are changes that may be made without departing from the scope of the invention.

What is claimed is:

1. An electronic circuit capable of providing precision current control including a linear slew rate, the electronic circuit comprising:

a constant current circuit to provide a constant current;

a transient current circuit coupled to the constant current circuit at a common electrical node, the transient current circuit to sample the constant current of the constant current circuit during a sampling phase, then provide a turn-on linear slew rate based on the sampled constant current during an active phase, the transient circuit including first switches, second switches, and a current-limited amplifier having an output coupled to a control input of a transistor and a first capacitor, the current-limited amplifier being configured in a voltage-follower configuration with a second capacitor coupled to a positive input of the current-limited amplifier, so that the current-limited amplifier and the transistor form a voltage-to-current converter that converts a voltage across the first capacitor to a current; and control circuitry to switch the transient current circuit between the sampling and active phases by closing the first switches and opening the second switches during the sampling phase, and opening the first switches and closing the second switches during the active phase, the second switches including at least an output switch arranged between the common electrical node and an output node that, while open, prevents current from exiting an output of the electronic circuit and a sampling switch arranged between the constant current circuit and the transistor that controls the transient current circuit to switch from the sampling phase to the active phase.

2. The electronic circuit of claim 1, wherein the first switches of the transient current circuit further includes at least two switches coupling the positive input of the current-limited amplifier to the constant current source.

3. The electronic circuit of claim 1, wherein the constant current circuit includes at least one transistor acting as a current mirror of another transistor.

4. The electronic circuit of claim 1, wherein the transient current circuit includes compensation circuitry to compensate for sampling current consumed during the sampling phase.

5. The electronic circuit of claim 1, wherein the transient current circuit includes a transient waveform circuit that defines a shape of the turn-on programmable slew rate coupled to a variable current controller.

6. The electronic circuit of claim 5, wherein the transient waveform circuit includes a capacitor in parallel with a resistor.

7. The electronic circuit of claim 5, wherein the transient current circuit directly samples the constant current of the constant current circuit during the sampling phase.

8. The electronic circuit of claim 5, wherein the transient waveform circuit includes a capacitor electrically in parallel with a constant current device.

9. The electronic circuit of claim 5, wherein the transient waveform circuit includes a capacitor electrically in parallel with a resistor.

* * * * *